US006625834B2

(12) United States Patent
Dean

(10) Patent No.: US 6,625,834 B2
(45) Date of Patent: Sep. 30, 2003

(54) MANUAL TOOTHBRUSH FOR GINGIVAL TISSUE STIMULATION

(76) Inventor: Peter W. Dean, 407-49 High St., Barrie, Ontario (CA), L4N 5J4

( * ) Notice: Subject to any disclaimer, the term of this patent is extended or adjusted under 35 U.S.C. 154(b) by 0 days.

(21) Appl. No.: 10/071,094

(22) Filed: Feb. 11, 2002

(65) Prior Publication Data

US 2003/0066146 A1 Apr. 10, 2003

Related U.S. Application Data

(63) Continuation-in-part of application No. 09/972,651, filed on Oct. 9, 2001, now abandoned.

(51) Int. Cl.[7] ..... A46B 9/04; A46B 13/08

(52) U.S. Cl. ..... 15/27; 15/23; 15/167.2

(58) Field of Search ..... 15/23, 27, 167.1, 15/167.2

(56) References Cited

U.S. PATENT DOCUMENTS

| | | | | |
|---|---|---|---|---|
| 887,181 | A | | 5/1908 | Barnes |
| 1,232,517 | A | * | 7/1917 | Ely |
| 1,254,532 | A | * | 1/1918 | Paul |
| 1,330,525 | A | | 2/1920 | Goldstein |
| 1,338,821 | A | * | 5/1920 | Eisner |
| 1,921,002 | A | * | 8/1933 | Ozabal |
| 2,066,241 | A | | 12/1936 | Trattner et al. |
| 2,093,383 | A | | 9/1937 | Rudof et al. |
| 2,175,975 | A | * | 10/1939 | Steiner |
| 2,771,624 | A | | 11/1956 | Ripper |
| 3,065,479 | A | | 11/1962 | McGee |
| 3,091,789 | A | * | 6/1963 | Haracz |
| 3,677,264 | A | * | 7/1972 | Brockman |
| 4,223,417 | A | | 9/1980 | Solow |
| 4,304,023 | A | | 12/1981 | O'Rourke |
| 4,317,463 | A | * | 3/1982 | Massetti |
| 4,320,774 | A | | 3/1982 | Rogers |
| 4,603,448 | A | | 8/1986 | Middleton et al. |
| 4,638,520 | A | * | 1/1987 | Eickmann |
| 4,757,570 | A | | 7/1988 | Haeusser et al. |
| 4,766,630 | A | | 8/1988 | Hegemann |
| 4,979,256 | A | * | 12/1990 | Branford |
| 5,054,149 | A | | 10/1991 | Si-Hoe et al. |
| 5,115,530 | A | | 5/1992 | Distiso |
| 5,137,039 | A | | 8/1992 | Klinkhammer |
| 5,142,724 | A | | 9/1992 | Park |
| 5,177,826 | A | | 1/1993 | Vrignaud et al. |
| 5,276,932 | A | | 1/1994 | Byrd |
| 5,311,633 | A | | 5/1994 | Herzog et al. |
| 5,537,708 | A | * | 7/1996 | Luposello |
| 5,699,575 | A | | 12/1997 | Peifer |
| 5,842,249 | A | | 12/1998 | Sato |
| 5,996,157 | A | | 12/1999 | Smith et al. |
| 6,256,826 | B1 | | 7/2001 | Darne |
| 6,343,396 | B1 | * | 2/2002 | Simovitz et al. |

FOREIGN PATENT DOCUMENTS

| | | | |
|---|---|---|---|
| BE | 894944 | | 3/1983 |
| EP | 1090566 | | 4/2001 |
| FR | 2548528 | | 12/1999 |
| GB | 459427 | * | 1/1937 |
| WO | 84/02833 | * | 8/1984 |
| WO | WO - 02/05679 A1 | | 1/2002 |

* cited by examiner

*Primary Examiner*—Randall E. Chin
(74) *Attorney, Agent, or Firm*—Marks & Clerk

(57) ABSTRACT

A preferably non-electric, non-mechanically actuated toothbrush is provided having a generally U-shaped appearance with a rotary brush located, during use, on each side of a tooth to be cleaned. The brushes are configured to rotate about an axis which is parallel to the long axis of the tooth to be cleaned, and essentially perpendicular to the buccal and lingual gum line, of the user. The brushes are preferably held in contact with the teeth and gum tissue by a resilient section of the toothbrush. In this fashion, a pushing and pulling motion during brushing results in a rotational motion of the brushes. An improved method for cleansing teeth, cleaning the opening to the gingival crevice area, and stimulation of the gingival tissue is provided.

4 Claims, 4 Drawing Sheets

MANUAL TOOTHBRUSH FOR GINGIVAL TISSUE STIMULATION

This application is a continuation-in-part of U.S. application Ser. No. 09/972,651, filed Oct. 9, 2001, now abandoned.

FIELD OF THE INVENTION

The present invention relates to a toothbrush and, in particular to a toothbrush for efficiently removing plaque from teeth, and for facilitating gingival tissue stimulation.

BACKGROUND OF THE INVENTION

Teeth are necessary for the mastication of food and for assisting with the formation of speech. In order for the teeth to perform their function over a long period of time, it is desirable for them to be cleaned by brushing on a regular basis in order to prevent plaque and calculus from being deposited on the crowns and roots of teeth, and thus provide protection against periodontal disease and tooth decay. Brushing also aids in maintaining healthy gums by stimulation of the gingival tissue which helps to maintain healthy supporting bone.

For brushing teeth, it has heretofore been customary to use standard toothbrushes having "tufts" of bristle assemblies planted on one face of one end of toothbrush handle. Additionally, electric toothbrushes, or toothbrushes powered by other means, such as water, have been developed in recent years that have also been widely used. The prior art manual or powered toothbrushes provide a variety of bristle sizes, shapes and configurations. By correct manipulation of the manual or powered toothbrush, the top and sides of the tooth, and the opening to the gingival crevice can be cleaned.

However, proper manipulation of the toothbrush is not always easy for most people, particularly, in the situation where the user is elderly, infirmed, disabled, or in the situation where the user is someone whose fine motor skills are either not fully developed, or are diminished. Further, manipulation of the toothbrush is not always easy where a persons' teeth are brushed by a second party due to the inability of the person to clean their own teeth. Under these circumstances, manipulation of the toothbrush to provide adequate cleaning of the teeth and stimulation of the gingival tissue can be difficult.

Improper manipulation of the brush can also adversely affect the health of the teeth and gums. The area of the tooth where the crown and root meet is referred to as the cemento-enamel junction. The root of the tooth is covered by cementum; a material which is softer than "enamel", and which is easily abraded by horizontal scrubbing. The areas of abrasion and recession caused by horizontal scrubbing extend through the cementum into the underlying dentin causing hypersensitivity and leaving the root areas much more prone to decay. In addition, fibres from the gum tissue which are attached to the cementum are brushed away and can not be reattached. Damage to both the root structure and the gum tissue is irreversible.

Correct brushing techniques with manual toothbrushes are extremely difficult to teach to the vast majority of people. Further, as a result of sheer frustration, most people will usually revert to horizontal scrubbing on the sides of their teeth. While this motion is acceptable if the user is brushing the harder, biting surfaces of the tooth, it is not advisable at the gum level for the reasons stated hereinabove.

In order to address these problems, a wide variety of manual toothbrushes and powered toothbrushes have been previously proposed. Some of these are described hereinbelow.

PRIOR ART

U.S. Pat. No. 5,842,249 (Sato) describes a toothbrush having a two or three sided channel (e.g. "U-shaped") with bristles on all interior surfaces of the channel. As the brush is moved over the teeth, the bristles clean both the internal and external sides, or the top and both sides, of the tooth. The configuration of the bristles is set so as to improve the efficiency of brushing of either the front teeth or the molar teeth.

Similar "channel" type toothbrushes are described in numerous patents including, for example, U.S. Pat. No. 887,181, U.S. Pat. No. 1,707,118, U.S. Pat. No. 2,066,241, U.S. Pat. No. 2,093,383, U.S. Pat. No. 2,771,624, U.S. Pat. No. 3,065,479, U.S. Pat. No. 4,757,570 and U.S. Pat. No. 5,137,039. In all of these patents the bristles are essentially fixed and cleaning of the teeth is accomplished by pulling the brush over the teeth.

U.S. Pat. No. 4,223,417 (Solow) also provides a "U-shaped" toothbrush. In this device, however, the side brushes are powered so as to vibrate in an up and down fashion in order to loosen materials at the gum line.

U.S. Pat. No. 5,142,724 (Park) describes a self-powered toothbrush with a rotary head which rotates on the surfaces of the tooth. A single rotary brush is described, which rotates about an axis perpendicular to the surface of the tooth being cleaned. Rotation of the brush is achieved by the difference pressures exerted on the brush surface as it is pulled along the surface of the tooth. Dame, in U.S. Pat. No. 6,256,826 provides an improved version of this toothbrush, which rotates more readily.

U.S. Pat. No. 5,276,932 (Byrd) describes a toothbrush having two rotary brushes powered by a mechanical linkage to a actuator located on the toothbrush handle. Again, however, the brushes both rotate about an axis located perpendicular to the surface of the tooth.

U.S. Pat. No. 5,115,530 (Distiso) describes an alternative arrangement for a toothbrush wherein a long bristle section is rotated about an axis which is parallel to the face of the tooth surface, and parallel to the gum line of the teeth being clean. Accordingly, the bristles move up or down the surface of the tooth.

U.S. Pat. No. 5,177,826 (Vrignaud et al.) describe a U-shaped toothbrush wherein the brushes located on the sides of the brush head both rotate. In this embodiment, the brushes both rotate about an axis which is perpendicular to the surface of the tooth being cleaned so that the brushes rotate around on the surface of the tooth. U.S. Pat. No. 4,766,630 (Hegemann) provides a similar device.

While these devices have met with limited success, it would be desirable to provide an improved toothbrush which provides for improved plaque removal and stimulation of the gingival tissue, particularly, for those people who have difficulty in the normal manipulation of a standard toothbrush.

SUMMARY OF THE INVENTION

Accordingly, it is a first object of the present invention to provide a toothbrush which provides improved cleansing of the portion of the tooth adjacent to the gingival tissue.

It is a further object of the present invention to provide a toothbrush which provides effective cleaning of the teeth and stimulation of the gingival tissue, particularly in the area adjacent to the opening to the gingival crevice.

It is a still further object of the present invention to provide a toothbrush which provides effective cleansing of the teeth for anyone, but particularly for those who have difficulty in manipulation of a standard toothbrush.

These and other objects are either fully or partially attained by providing a toothbrush having a generally U-shaped head with rotating brushes located on the sides of the toothbrush head, wherein the brushes rotate about an axis which axis is essentially parallel to the long axis of the tooth, and also with bristles essentially perpendicular to the buccal (facial) and lingual surfaces, of the teeth being cleaned.

Accordingly, the present invention provides a toothbrush comprising:

an elongated handle; and a brush head section, and preferably a U-shaped brush head section, wherein said brush head section comprises:

a main head section, a rotary brush located on each side of the main head section adapted to be located, in use, on the buccal and lingual side of a tooth to be cleaned; and an axle for each rotary brush wherein said axle connects said rotary brush to said main head section;

characterized in that each of said rotary brushes rotates about said axle so that the axis of rotation of each brush is essentially parallel to the long axis of the tooth.

The axis of rotation of each brush is, in use, located on the lingual and buccal side of the teeth, and is therefore, the bristles of the rotary brushes are essentially perpendicular to the buccal and lingual surfaces of the teeth being cleaned. The "long axis of the tooth" is generally, the axis of the tooth which runs from the centre of the root structure, to the centre of the biting surface of the tooth, and is essentially the centre line of the tooth. Accordingly the long axis of the tooth runs vertically from the tip of the root structure to the centre of the biting surface of the tooth.

Additionally, the toothbrush can additionally comprise a third brush to cleanse the biting surface of the tooth, where horizontal scrubbing, in this application, is permissible.

The brushes are preferably held in contact with the tooth and gum tissue by a biasing means, such as, for example, a spring or by a resilient section of the axle or main head section. This can allow the brush to be used to clean teeth of different width, such as, for example, cleaning either the incisors, cuspids, or molar teeth since the biasing means would automatically adjust to the different tooth widths.

While the rotary action of the rotary brushes might be provided or assisted by an external power source, such as an electric motor, water or air pressure, or by a mechanical actuating device, preferably, the brushes rotate as a result of the pushing or pulling, horizontal, longitudinal movement of the brush head along the line of teeth to be cleaned. Accordingly, the brush is preferably a non-electrically and/or non-mechanically powered brush. This is accomplished by providing a brush which contacts the tooth, at rest, and which can freely rotate about its axle so that linear movement of the brush head causes the brush to rotate.

It is also preferred that the resiliency of the bristles of the brush, and/or the biasing means used be such that the brushes are normally held in contact with the teeth.

BRIEF DESCRIPTION OF THE DRAWINGS

Various embodiments of the toothbrush of the present invention will now be described by reference to the following drawings wherein.

DETAILED DESCRIPTION OF THE PREFERRED EMBODIMENTS

Figure 1:
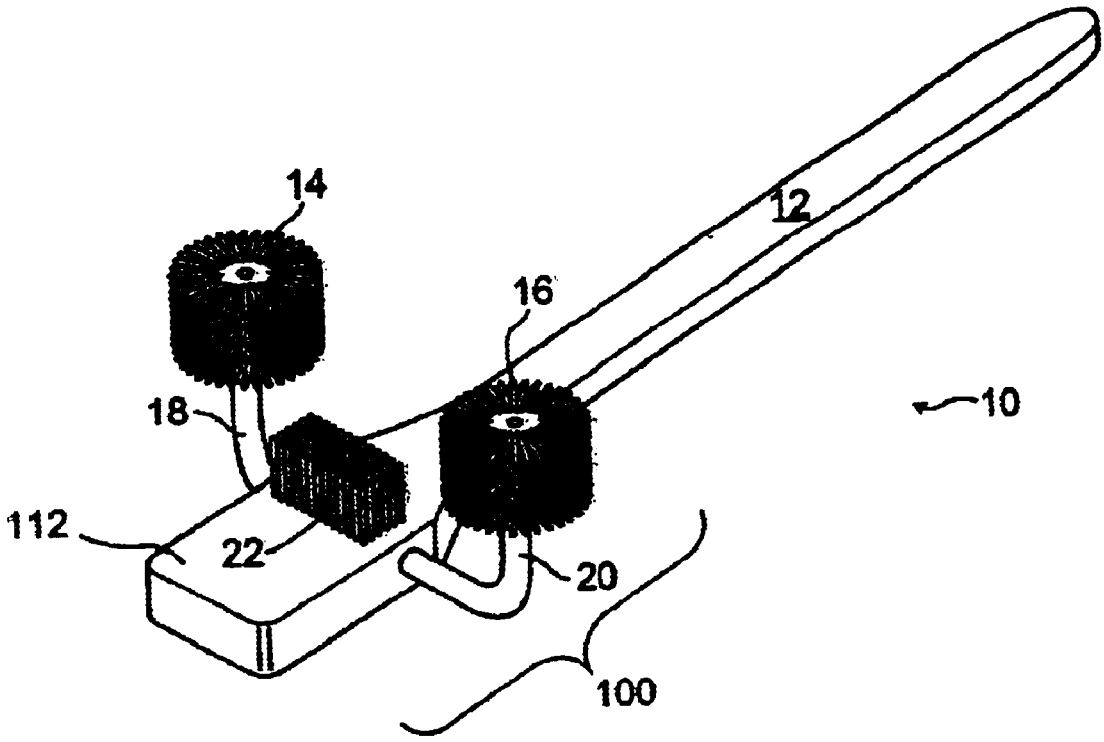
FIG. 1 is a perspective view of a tooth brush according to the present invention.

Various features of the toothbrush of the present invention, as well as other objects and advantages attendant thereto, are set forth in the following description and the accompanying drawings in which like reference numerals depict like elements.

In FIG. 1, a toothbrush, generally depicted as 10, is shown which toothbrush is in accordance with the present invention. Toothbrush 10 has a handle section 12 which can be used to manipulate toothbrush 10 in, for example, a manner similar to known, standard toothbrush designs. At one end of handle section 12 is toothbrush head section 100 which consists, in this embodiment, of fixed brush section 22 which is affixed to head main section 112, and axle sections 18 and 20 which extend from the sides of head main section 112. Mounted on axle sections 18 and 20 are brush sections 14 and 16, respectively, wherein each brush section comprises a plurality of bristles collected together in "tufts" of bristles, in a fashion similar to known toothbrush bristle designs.

The bristles are preferably chosen by the skilled artisan to be soft, pliable and bendable, yet still resilient enough to clean accumulated plaque while not being sufficiently hard to harm the gum tissues or the teeth. However, the bristles should be firm enough to convert the energy of the longitudinal movement of brush 10 along the teeth of the user, into a rotational motion of rotary brushes 14 and 16. Accordingly, it is necessary that the bristles should be long enough so that the bristles of each brush are in contact (in normal use) with either side (the buccal (facial) and the lingual sides) of the tooth and/or the adjacent gum tissue It should be noted that the longitudinal brushing motion is not generally desirable, since it can lead to abrasion of the side surfaces of the teeth. However, this motion is a common, natural tendency for individuals to use when brushing their teeth. Use of the toothbrush of the present invention allows a user to follow their natural brushing tendency, and translates the motion into a much more desirable rotary action of the brush which minimizes or eliminates abrasion.

Figure 2:
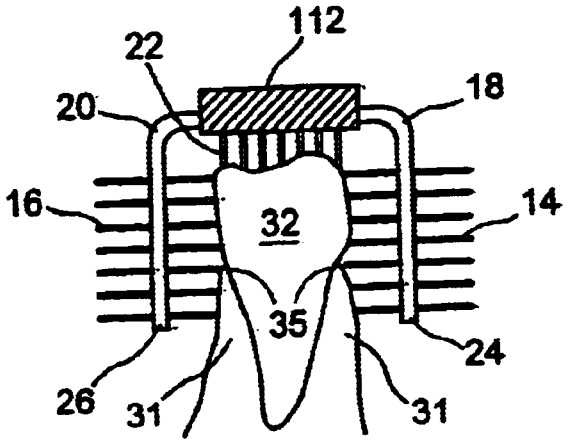
FIG. 2 is a cross-sectional view of the brush head section of FIG. 1.

FIG. 2 provides additional detail of the toothbrush design wherein the tufts of bristles are attached to rotary brush cores 24 and 26. The rotary brush cores 24 and 26 are essentially hollow tubes to which the bristle tufts can be attached, and through which axles 18 and 20 can extend.

Brushes 14 and 16, and even brush 22 may be permanently affixed to toothbrush 10, but alternatively, each brush section might be separately replaceable. The bristle tufts shown in brushes 14 and 16 are shown as being essentially perpendicular to rotary brush cores 24 and 26. However, the bristle tufts may be positioned at different angles, or at a variety of different angles on each brush, in order to adjust the cleaning properties of the toothbrushes of the present invention. By selection of a variety of brush bristle angles, lengths, stiffnesses and the like, the brushes can effectively cleanse the surfaces of the teeth, cleanse and stimulate the gingival tissues, and extend (at least partially) into any concave gaps within or between the teeth.

In use, as the brush is moved horizontally along the line of the teeth, (or, more generally, the gum line of the teeth) with a pushing and pulling motion, brushes 14 and 16 are caused to rotate as a result of the contact between brushes 14 and 16 and tooth 30. Brushes 14 and 16 will, as a result of the movement of brush 10 along the teeth, rotate in opposite directions. As a result of the rotary brush rotation, tufts from brushes 14 and 16 are able to effectively stimulate the gingival tissue 31 of the sides of tooth 30 in the area where tooth 30 meets with the gum 32.

The rotation of brushes 14 and 16 is effective at removal of material from the entrance of the gingival crevice area by gently forcing bristles from brushes 14 and 16 just beneath the gum line 35, and sweeping out any particles or materials at or just below the gum line 35 as a result of the brush rotation. It should be noted that brushes 14 and 16 extend below the gum line 35 (i.e. at the junction of the crown of the tooth and the gum tissue) on the buccal and lingual sides of the tooth. As such, the rotation of the brushes also massages and/or otherwise stimulates the gum area which can aid in maintaining the health of the gums, and in turn, the underlying bone structure for the tooth.

Additionally brush 22 cleans the top section of tooth 30. Brush 22, when in contact with the biting surface of the tooth, also provides a limit on the extent to which the rotary brushes can extend on the sides of the tooth, and the adjacent gum tissue. Thus brush 22 also acts as a positioner to position the rotary brushes at a depth where they can provide optimal cleansing and stimulation.

Brush head section 100, and in particular, head main section 112, is shown in FIG. 1 as being permanently affixed to the end of handle 12. However, it should be clear to those skilled in the art that head main section 112 may be attached to handle section 12 through a flexible section, or through a connector which allows head main section 112 to rotate with respect to handle 12 through an axis of rotation which runs vertically through handle section 12. Manipulation of the handle 12 in order to keep the brushes 14 and 16 of brush head section 100 aligned with the teeth, may be facilitated as a result of the use of this connector. While the head main section 112 might be produced so that it can freely rotate with respect to handle 12, it is typically preferred that the head main section be limited to a rotation of less than 45 degrees, and more preferably, less than 30 degrees from the line established by extending a longitudinal axis line of handle 12.

Handle 12 and any part of, or all of head main section 112 (other than the bristles of the brushes) are preferably made of a resilient or hard plastic materials, although a wide variety of other materials, such as stainless steel might also be used.

Axles 18 and 20 are also preferably made of a resilient plastic material so as to provide a biasing force to keep the brushes in contact with the teeth being cleaned and/or the gum tissue bing stimulated. Alternatively, a spring, or other such device could be included to provide a biasing force on brushes 14 and 16. The biasing force on brushes 14 and 16, when present, should be sufficient to maintain contact between the brushes and the user's teeth, but should not be so great so as to cause the brushes to be pressed into the tooth to the extent that rotation of the brush is unduly restricted.

The brushes are preferably freely rotatable about the axle, and thus can rotate freely as the brush main head section is pulled or pushed along the line of the teeth. However, it might also be desirable to reduce or limit the rotation rate of the rotary brush, and therefore the rotary brush might be provided with a frictional force, for example, by providing drag on the axle, so as to reduce the rate of rotation. Also, the rotary brushes could be fitted with a ratchet system whereby rotation of the brush was only allowed as the brush was moved in one direction, while being held in a fixed position when moved in the other direction. Further, the rotary brushes could also be fitted with a locking system to hold them in place, for cleaning or replacement, or the like.

Those skilled in the art will be aware that brush head section 100 can be a variety of shapes and sizes. For example, the brush head section might be produced so as to essentially totally surround the brushes, and leaving only a channel into which the user's teeth would fit.

Concurrently, or alternatively, a protective shield might be provided around the rotary brushes to avoid contact with, and possible irritation of, the cheek area or the tongue of the user.

Preferably, the brush head section is kept small so as to allow the brush head section to be easily moved within the mouth of the user. However, the toothbrush of the present invention could be produced in a vary of sizes so that the user can select the toothbrush size most appropriate for their own use. Also, the resiliency of axles 18 and 20, or such other biasing means as might be used, can assist in allowing some flexibility in the size of head section 100.

The axles of for the rotary brushes might also be provided by a structure wherein one bent, common axle is used for both rotary brushes, in an arrangement, for example, similar to the design of a staple. The common axle might also be used for support of the fixed brush. This embodiment is best seen in FIG. 3.

Figure 3:
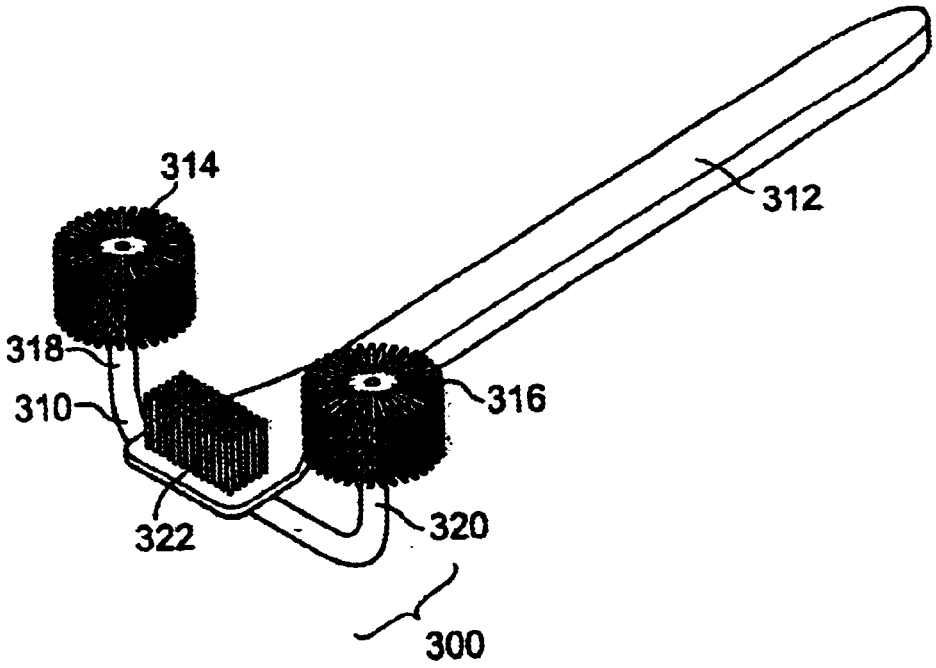
FIG. 3 is a perspective view of an alternative embodiment of a tooth brush according to the present invention.

In FIG. 3, a tooth brush is shown having a handle section 312 with a brush head section 300. Brush head section 300 is attached to handle section 312 at one end of handle section 312, and is primarily comprised of a common "staple-shaped" (or U-shaped) axle 310 to which brushes may be attached. Common axle 310 provides a first axle 318 and a second axle 320 for support of brushes 314 and 316. Common axle 310 also acts as support for fixed brush 322.

Common axle 310 is made of a resilient plastic material so as to provide a means for exerting a force to keep the bristles of brushes 314 and 316 in contact with the teeth, and/or gingival tissue of the user.

Typically, the axles for the rotary brushes of the toothbrush of the present invention are essentially parallel. However, in order to further aid in keeping the bristles of the rotary brushes in contact with the teeth and/or gingival tissue, the axles of the rotary brushes can be angled towards each other to provide a torsional effect which aids in keeping at least one part of each rotary brush in good contact with the teeth or gingival tissue. This may also assist in providing a good rotary motion, with minimal excessive contact with the teeth. Typically, when using this approach, the axles of the brushes are preferably less than 10 degrees off of parallel with respect to one another, and more preferably, less than 5 degrees off parallel.

Figure 4:
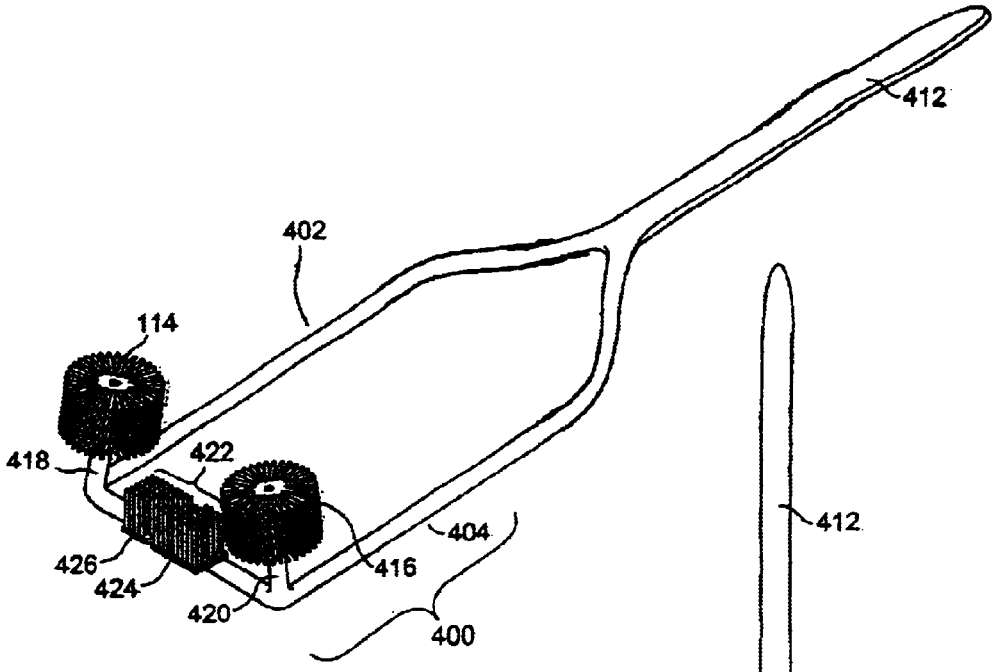
FIG. 4 is a perspective view of a still further alternative embodiment of a tooth brush in accordance with the present invention.
Figure 5:
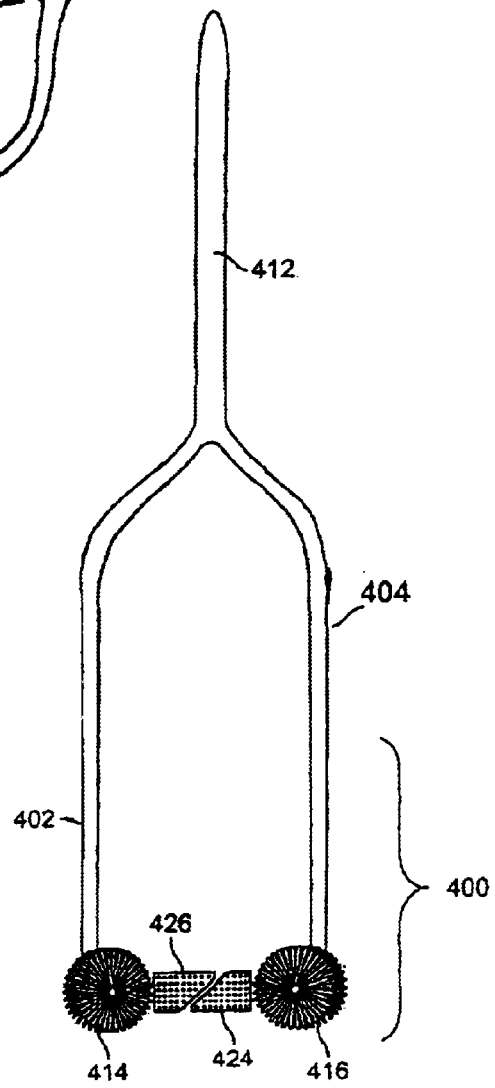
FIG. 5 is a bottom plan view of the toothbrush of FIG. 4.

In FIG. 4, an alternative embodiment of the tooth brush of the present invention is shown. In this embodiment, a foreshortened handle section 412 is connected to brush head section 400. Brush head section 400 comprises a "wishbone" shaped section having two substantially parallel arms 402 and 404. At the end of each arm is an axle section 418 and 420 to each of which are attached one rotary brush (either 414 and 416) in a manner to that described previously. Arms 402 and 404 are made of a resilient plastic material which can exert a force to cause rotary brushes 414 and 416 to be kept in contact with the teeth. Fixed brush 422 is comprised of two overlapping "V-shaped" sections 424 and 426, each of which is fixed to one arm 402 or 404 only. By overlapping sections 424 and 426, complete coverage of the biting surface of the tooth is provided. However, since brush sections 424 and 426 are not connected, arms 402 and 404 are free to flex in order to keep rotary brushes 414 and 416 in contact with the user's teeth. FIG. 5 provides a bottom view of brush head section providing additional details.

The rotary brushes may be assembled by providing an essentially hollow tube into which tufts of bristles can be inserted. In an alternative embodiment, however, each rotary brush is assembled by stacking a series of brush disk sections on top of one another. Each brush disk section can hold different bristle configurations so as to provide a rotary brush with different bristle lengths, tuft patterns, tuft angles, bristle siftnesses, cross-sectional profiles (round, ovoid, etc.) and the like.

Figure 6:
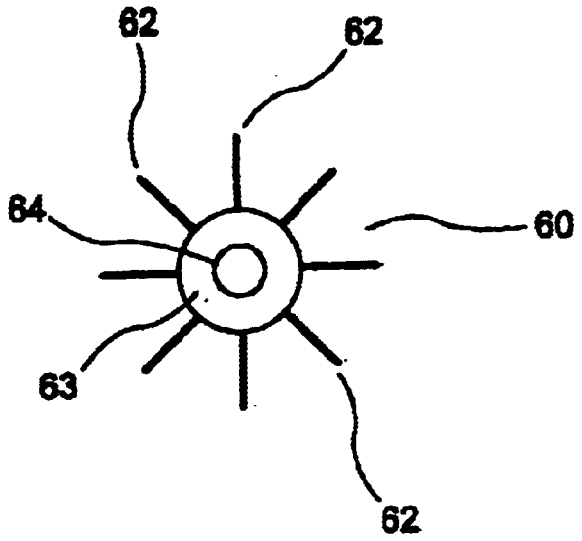
FIG. 6 is a perspective view of a portion of a rotary brush disk.

In FIG. 6, a brush disk section 60 is shown having a central core 63 made of a plastic material. Bristle tuft sections 62 have been inserted into the central core 63 and radially protrude from the surface of core 63. Alternatively, the bristles could be molded in place as the disk section is formed. At the centre of core 63 is a hole 64.

Figure 7:
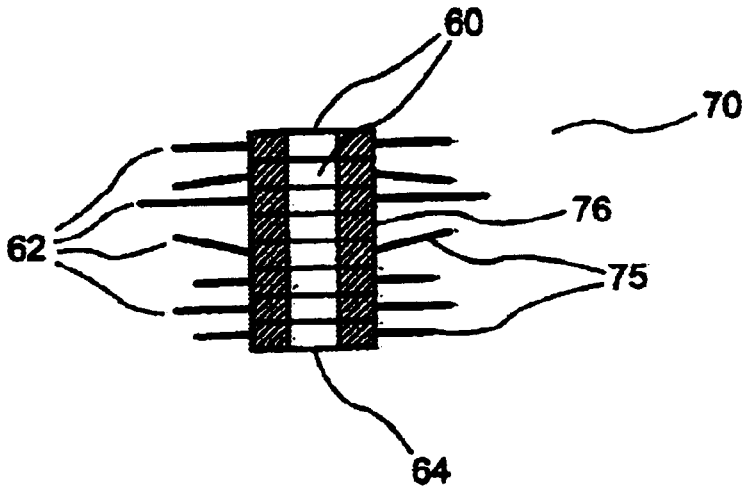
FIG. 7 is a cross-sectional view of an assembled rotary brush which has been prepared from the brush disks shown in FIG. 6.

In FIG. 7, a rotary brush 70 is shown in cross-section which has been prepared by stacking a number of disk sections 60 as shown in FIG. 6 on top of one another. For each disk section, hole 64 is in alignment so as to produce an axle-receiving hole extending through the length of brush 70. By selection of a number of different disk sections, various combinations of bristle or bristle tuft 75 properties can be selected. Also, disks 76 which do not contain any bristles might be used to provide spaces between the bristle-bearing disks.

Disks 60 are preferably ultrasonically welded together so as to provide a "one-piece" rotary brush 70.

In an additional embodiment, the rotary brush can contain one, or a plurality of preferably flexible interdental stimulation tips which can act to provide interdental stimulation in the gap formed between the teeth. The flexible tips are preferably made of a soft, resilient plastic or rubber material which allows, as the brush rotates, the flexible tip to slide along the gingival tissue and thus engage and/or enter the interdental space bounded by the surfaces between two teeth and the gingival tissue. This action provides stimulation of gingival tissue and also aids in removing any plaque or other material found within the interdental space.

As the rotary brush is moved along the surfaces of the teeth, the tip will disengage from one interdental space and the brush will rotate so as to provide the same or a similar flexible tip which can enter and/or engage the next interdental space. The process is repeated in either the forward or backward direction as the brush head is moved in the fashion previously described.

Accordingly, a flexible tip can enter the interdental space from either the buccal or lingual surfaces. For example, the tip(s) from the lingually positioned rotary brush enters the lingual aspect of the interdental space(s), while the tip(s) of the buccally positioned rotary brush enters the buccal aspect of the interdental space(s).

The tip is preferably generally cone-shaped and might be triangular (in cross-section), triangular with concave surfaces (in cross-section), triangular with blunted edges (in cross-section), or cylindrical. Preferably all have tips, however, will taper essentially to a point.

The flexible tip can be smooth, or can have some texture.

The rotary brush might be set so as to contain only flexible tips for interdental stimulation. Alternatively, a disk 60, as described in respect of FIG. 7, might contain one or more flexible tips, such as, for example, 2, 3, 4, 6 or 8 flexible tips per disk. This disk might then be combined with other disks which contain brush bristles.

Thus, it is apparent that there has been provided, in accordance with the present invention, a toothbrush which fully satisfies the means, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

We claim:

1. A toothbrush comprising:

an elongated handle which comprises a first handle section and a wish bone shaped structure, which provides two arms, and which wish bone shaped structure is attached to said first handle section; and a brush head section connected to said elongated handle, wherein said brush head section comprises:

a main head section having an axle located on each of said arms;

a rotary brush operatively connected to each of said axles, and adapted to be located in use, on the buccal and lingual side of a tooth to be cleaned; and wherein said axle connects said rotary brush to said main head section, characterized in that each of said rotary brushes rotates about said axle so that the axis of rotation of each brush is essentially parallel to the long axis of the tooth, and wherein said brush head section additionally comprises a third brush, located perpendicular to and between said axles, and which third brush is attached to said main head section to brush the top surface of the tooth.

2. A toothbrush as claimed in claim 1 wherein said third brush is split so as to comprise two split brush sections, and wherein a split brush section of said third brush is attached to each arm.

3. A toothbrush as claimed in claim 2 wherein said split which establishes said split brush sections provides a gap between said split brush sections of said third brush, so that the distal end of one arm is not connected to the distal end of the other arm.

4. A toothbrush as claimed in claim 2 wherein said gap between said split brush sections is on an angle with respect to said handle so that said split brush sections overlap when said toothbrush is moved along the line of teeth to be cleaned.

* * * * *